United States Patent [19]

Taylor

[11] 4,208,646

[45] Jun. 17, 1980

[54] THERMALLY RESPONSIVE ELECTRIC SWITCH

[76] Inventor: John C. Taylor, 9 Homefield Park Ballasalla, Castletown, Isle of Man

[21] Appl. No.: 888,632

[22] Filed: Mar. 21, 1978

[30] Foreign Application Priority Data

Mar. 23, 1977 [GB] United Kingdom ..... 12287/77
Jul. 25, 1977 [GB] United Kingdom ..... 31131/77

[51] Int. Cl.[2] ..... H01H 37/02; H01H 37/52

[52] U.S. Cl. ..... 337/372; 337/85; 337/365

[58] Field of Search ..... 337/365, 372, 85, 89, 337/333, 334, 343, 362, 373, 379

[56] References Cited

U.S. PATENT DOCUMENTS

| | | | |
|---|---|---|---|
| 2,790,046 | 4/1957 | Richardson et al. | 337/85 |
| 2,916,586 | 12/1959 | Kuhn | 337/89 |
| 3,066,206 | 11/1962 | Dales | 337/379 |
| 3,067,306 | 12/1962 | Epstein | 337/365 |
| 3,430,177 | 2/1969 | Audette | 337/365 |
| 4,103,269 | 7/1978 | Grable et al. | 337/85 |

FOREIGN PATENT DOCUMENTS

| | | | |
|---|---|---|---|
| 2720449 | 11/1977 | Fed. Rep. of Germany | 337/365 |
| 939448 | 10/1963 | United Kingdom | 337/334 |

*Primary Examiner*—Harold Broome
*Attorney, Agent, or Firm*—Fishman and Van Kirk

[57] ABSTRACT

A thermally responsive electric switch for protecting electric motors comprises two sheet metal switch terminal members, one switch member having ear portions deformed around the other switch member to secure the switch members together. An intervening strip of insulation maintains electrical isolation between the two switch members and may be impregnated with adhesive to bond the switch members. One switch member mounts a thermally responsive bimetallic actuator carrying a movable contact and the other mounts a fixed contact. The fixed contact projects through an aperture in the insulation, such aperture registering with an aperture in the switch member carrying the movable electrical contact so that the electrical contacts engage by way of the registering apertures; thus the contacts are disposed in a protected position. Interengaging recesses and dimples may be provided in the switch members to prevent relative rotation therebetween.

14 Claims, 5 Drawing Figures

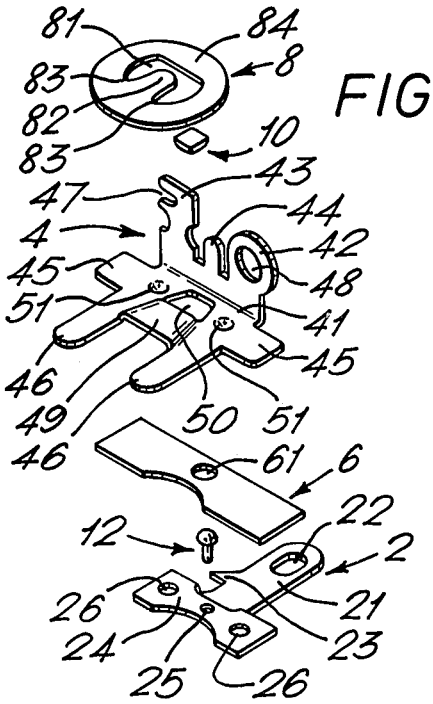
FIG.1.
FIG.2.
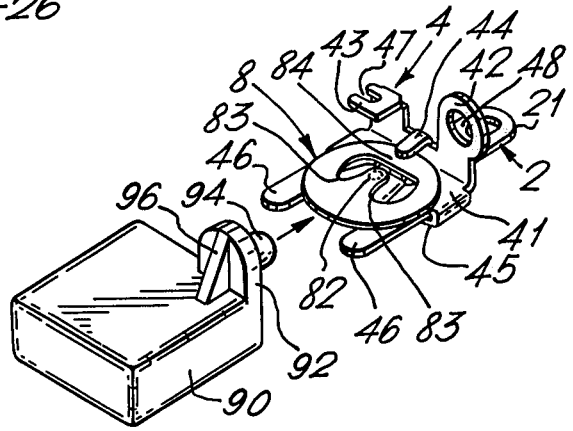

THERMALLY RESPONSIVE ELECTRIC SWITCH

The present invention relates to a thermally responsive electric switch included a bimetallic snap-acting switch actuator.

The present invention is particularly concerned with such switches employing actuators of the kind comprisng a sheet or strip of flexible bimetallic material having a tongue released therefrom between two outer legs the tongue being connected to the sheet or strip at one end and being free of the sheet or strip at the other end, and the sheet or strip being permanently deformed so as to be movable with changes in temperature between two positions on either side of an intermediate unstable position with a snap-action. Such actuators are described in British Pat. No. 657,434 and U.S. Patent application Ser. No. 874,012 and hereinafter will be referred to as being "of the kind described".

An important application of thermally responsive switches is in protecting electric motors from over heating conditions. Electric motors, particularly permanent magnet 12 volt D.C. motors, are commonly employed in motor vehicles for various ancilliary functions and may be physically very small in size. It is an object to the present invention to provide a thermally responsive electric switch which is of a construction such that it may be sufficiently small in size to be incorporated in a small electric motor for the protection thereof.

The present invention provides a thermally responsive electric switch including two switch members, formed from sheet metal, disposed face to face and electrically isolated from one another by a layer of electrical insulation positioned therebetween. The switch members are secured together by mechanical inter engagement with one switch member mounting a stationary electrical contact and the other switch member mounting an actuator of the kind described. A movable electrical contact is mounted on the actuator of the kind described for engagement with said stationary electrical contact.

The switch according to the invention is of a particularly simple construction, the body of the switch merely comprising two sheet metal members with an intervening layer of insulation. Thus the switch may be of small size overall and is particularly suitable for use in protecting small electric motors. Furthermore whilst the construction is particularly suitable for producing an extremely small switch, the switch itself is particularly durable under the arduous conditions of high temperature and vibration inside the elctric motor. The construction allows the switch to be manufactured accurately and is ideal for automatic or semi-automatic production methods.

Said insulation layer is preferably formed of a sheet material e.g. paper. The paper may be a polyamide based material.

Said switch members are preferably formed by stamping and pressing metal sheet to the required configuration. One switch member may be provided with laterally extending ear portions which are crimped around the other switch member together with the intervening layer of insulation to mechanically interengage the switch members and thus secure the switch members together. Other forms of mechanical inter engagement may be envisaged. For example, tag portions of the switch members could be twisted together or a rivet portion of one switch member could be rivetted through an aperture in the other switch member. However such methods might not be as reliable as crimping and might carry the risk of destroying the electric isolation between the switch members.

Where the switch members are crimped together by laterally extending ear portions of one switch member extending around the other switch member, then it is desirable to ensure that there can be no relative rotational or translational movement between the switch members which might result in misalignment of the electrical contacts or destruction of the electrical isolation between the switch members.

One possibility is to arrange for the ear portions to engage in slots in the other switch member when they are crimped around the other switch member. However there would be a risk of damaging the electrical insulation with consequent electrical interconnection of the two switch members. Alternatively two pairs of laterally extending ear portions may be provided, the ears of one pair extending in transverse directions to the ears of the other pair so that when the two pairs of ears are crimped about the other switch member, then there can be no relative rotation or translation.

As preferred a single pair of laterally extending ear portions are provided for crimping, and the switch members are shaped to matingly engage in a direction transverse to their adjacent inter engaging faces. Of the various shapes and configurations conceivable, it is preferred to provide one or more rounded projections on one face of one switch member which engage in recesses or apertures in the other switch member. The apertures or recesses and projections are so shaped and dimensioned so as to avoid any risk of damaging the layer of electrical insulation upon mating engagement.

The switch members preferably include integral electrical terminal portions for the electrical connection of the switch.

Said stationary electrical contact secured to one switch member may project through an aperture in the insulation layer; the other switch member may have a registering aperture and the movable electric contact carried by the switch actuator is positioned to engage a stationary electrical contact via the registering apertures. This has the advantage of the electrical contacts being disposed in a position protected from accidental knocks which may cause the spacing of the contacts to be altered, giving rise to faulty operation. The actuator is preferably spot welded to the switch member at a single point either on the periphery of the actuator or at the free end of the actuator tongue.

As an additional means of securing together the component parts of the switch, the layer of insulation may be impregnated with an adhesive e.g. araldite or adhesive may be positioned at the interfaces between the insulation and the switch members whereby to bond the switch members to the insulation Preferred embodiments of the invention will now be described with reference to the accompanying drawings wherein:

FIG. 1 is an exploded perspective view of a preferred embodiment of the switch according to the invention;

FIG. 2 is a perspective view of the switch of FIG. 1 with a cover for shrouding the switch components;

Figure 3:
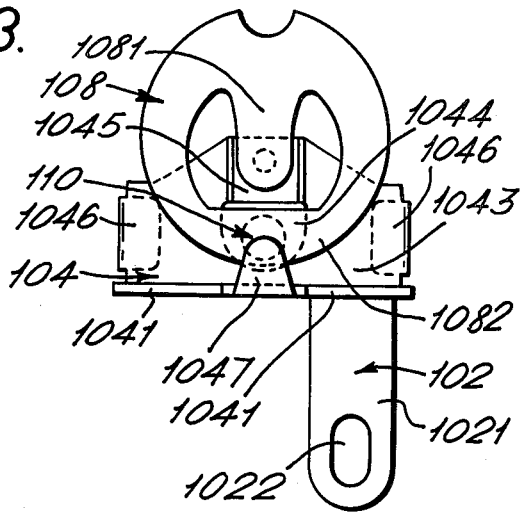
FIG. 3 is a front elevation view of a further embodiment of a thermally responsive switch according to the invention.

Referring to FIGS. 1 and 2, there is shown a preferred form of thermally responsive electric switch in accordance with the present invention, the switch comprising two switch members respectively indicated generally at 2,4. The switch members are formed by stamping and pressing brass sheet. Positioned between switch members 2,4 is a strip of insulation 6 of a polyamide based paper. A thermally responsive bi-metallic actuator 8 is provided, mounted on switch member 4. Actuator 8 carries a moveable switch contact 10 which in the normal condition of the switch makes contact with a stationary contact 12 mounted to switch member 2.

In more detail, switch member 2 comprises a terminal portion 21 having an aperture 22 for an external electrical connection (aperture 22 can if desired be omitted). Terminal portion 21 has, in addition, a barb portion 23 for maintaining an external electrical connection. Terminal member 2 has a main portion 24 disposed transverse to terminal portion 21, main portion 24 having an aperture 25 therein for receiving the stationary electrical contact 12 which is riveted into aperture 25. As an alternative construction aperture 25 may be omitted and the stationary electrical contact 12 may be welded to portion 24. Main portion 24 also has two apertures 26 which are provided for a purpose to be described below. The switch member 4 comprises a main portion 41, a mounting boss 42, a terminal portion 43, a back-stop portion 44, laterally extending ear portions 45 and lug portions 46. Switch member 4 is shown in FIG. 1 in a pre-assembly condition wherein mounting portion 42, terminal portion 43, and back-stop portion 44 are all disposed perpendicularly to main portion 41. In addition ear portions 45 extend in the same plane as main portion 41. In the assembled condition of the switch as shown in FIG. 2 ear portions 45 are bent or wrapped around main portion 24 of switch member 2 and terminal portion 43 together with back-stop portion 44 are bent in planes spaced from but parallel to main portions 41 of switch member 4.

Terminal portion 43 has a recess 47 in one edge of the terminal portion in order to improve an external electrical soldered connection. Mounting portion 42 has an aperture 48 by which the switch may be mounted to a mounting member. Main portion 41 has a raised portion 49 to which the actuator 8 is mounted. An aperture 50 is provided adjacent raised portion 49 through which electrical contact may be made between the stationary electrical contact 12 and the moveable electrical contact 10. Two raised domed projections 51 (the underside of which can be seen in FIG. 1) are provided in main portion 41 for a purpose to be described.

Insulation strip 6 of polyamide based paper has a central aperture 61.

Thermally responsive actuator 8 is of the kind described and claimed in co-pending application Ser. No. 874,012 and comprises a thermally responsive bimetallic actuator comprising a member of sheet bi-metal having an aperture 81 therein with an outer perimeter and an inner perimeter defining a tongue 82 free at one end said outer and inner perimeters smoothly merging at rounded ends 83 of the aperture adjacent the tongue root, the member having been deformed in a die pressing operation to conform in shape to a die of domed configuration such as to reverse its curvature with a snap action with a change in temperature and the width, measured radially from the centre of the member, of that part of the member surrounding tongue being greatest in the region of the tongue root. The free end of the tongue 82 is secured to raised portion 49 of switch member 4 either by a spot welding operation or by forming an eyelet in raised portion 49 and riveting the eyelet through an aperture performed in the free end of the tongue 82 of the actuator. Electrical contact 10 is mounted to the periphery of actuator 8 in the region 84 directly opposite the free end of the tongue 82.

In the assembled switch shown in FIG. 2 moveable contact 10 is positioned adjacent aperture 50 whereby in the normal condition of the switch the moveable contact engages stationary contact 12. Stationary contact 12 projects through aperture 61 in paper strip 6 in order to engage with moveable contact 10 in the region of aperture 50.

In the assembled form of the switch, paper strip 6 is sandwiched between the main portions 24, 41 of switch members 2,4. Ear portions 45 are wrapped around main portion 24 of terminal member 2 together with the ends of strip 6 in order to mechanically inter-engage the two switch members and to secure the switch together. Paper strip 6 maintains electrical isolation between the two switch members. With the two switch members mechanically inter-engaged, raised domed portions 51 of switch member 4 engage in apertures 26 in switch member 2 and this inter-engagement serves to prevent relative movement by rotation or displacement in a direction perpendicular to ear portions 45 whereby to provide a safe and secure assembly of the switch.

In operation of the switch shown in FIGS. 1 and 2, electrical current passes between the switch members 2,4 by way of stationary contact 12 and moveable contact 10 carried by actuator 8. If the actuator is heated, either by excess current flowing through the switch or by the ambient temperature of the switch rising beyond the break temperature of the switch, the switch snap-acts at a perdetermined temperature to an oppositely dished configuration wherein electrical contact is broken between moveable contact 10 and stationary contact 12.

A cover may be provided for the switch of FIGS. 1 and 2; this is shown in FIG. 2 and comprises a rectangular main portion 90 enclosing the switch apart from the switch terminal portions. An ear portion 92 of the cover extends perpendicularly from the base of the cover and is provided with a projecting portion 94 configured to be positioned within aperture 48 of mounting boss 42 in order to locate the cover on the switch. A reinforcing rib 96 is provided for the ear portion 92.

Figure 4:
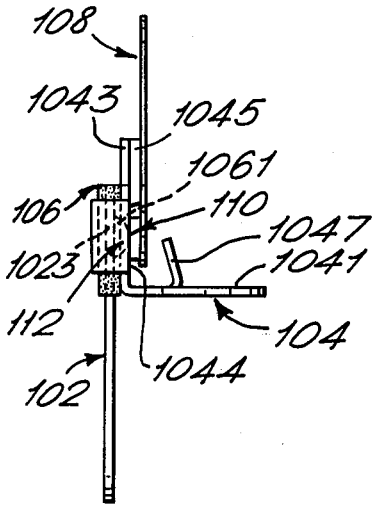
FIG. 4 is a side view of the switch of FIG. 3.
Figure 5:
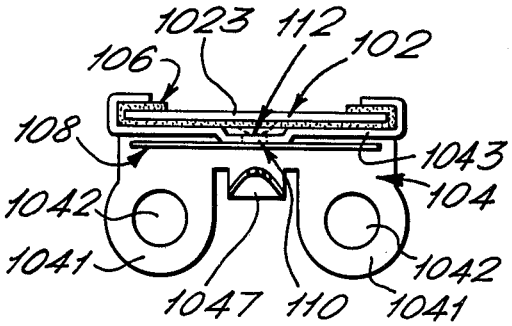
FIG. 5 is a top plan view of the switch of FIG. 3.

Referring now to the second embodiment of a thermally responsive electric switch according to the invention shown in FIGS. 3 to 5, the switch comprises two switch members 102, 104, an intervening layer of insulation 106, a thermally responsive bimetallic actuator 108, a moveable electrical contact 110 and a stationary electrical contact 112.

Switch member 102 comprises a terminal portion 1021, an aperture 1022 for an external electrical connection. Member 102 has a main portion 1023 with an aperture therein for receiving stationary electrical contact 112 riveted therein. Alternatively, the electrical contact 112 can be welded directly to main portion 1023.

Switch member 104 comprises two terminal portions 1041 having apertures 1042 therein for external electrical connections. These terminal portions extend transversely to a main portion 1043 of the switch. An aperture 1044 is provided centrally of main portion 1043 in order to permit electrical contact between the electrical contacts of the switch as is described below. A raised portion 1045 of main portion 1043 is located above aperture 1044 and is provided for mounting the switch actuator. Laterally extending ear portions 1046 are provided on opposite side edges of main portion 1041. A back-stop portion 1047 is provided between terminal portions 1042.

Insulative-paper strip 106 positioned between terminal members 102, 104 is impregnated with adhesive in order to bond the two switch members together. Paper strip 106 has a central aperture 1061 through which stationary electrical contact 112 projects.

Thermally responsive actuator is similar to the actuator described in the embodiment of FIGS. 1 and 2 and in particular has a tongue 1081 the free end of which is spot welded to raised portion 1045. The region 1082 directly opposite the free end of the tongue carries moveable contact 110.

The switch is secured together by means of the adhesive bond between the two switch members and also by the wrapping of the ears 1046 together with paper 106 around terminal member 102.

In operation of the switch, the electrical contacts 110, 112 normally engage each other via aperture 1045. Should the temperature of the actuator rise above its break temperature either by excess current flowing through the switch and/or a high ambient temperature for the switch, the actuator snap-acts to an oppositely dished configuration wherein electrical contact is broken between the electrical contacts. In this condition the actuator abuts the back-stop 1047 and this back-stop limits movement of the actuator.

What is claimed is:

1. A thermally responsive electric switch including two switch members formed from sheet metal, said switch members being disposed in face to face relationship, said switch members being electrically isolated from one another by a layer of electrical insulation sandwiched therebetween, at least a first of said switch members being physically deformed whereby said switch members are secured together by mechanical interengagement with one another, a first one of said switch members mounting a stationary electrical contact and a second one of said switch members mounting a snap-acting actuator of sheet bi-metal, said actuator being mounted on the face of said second switch member disposed opposite to that face which is in contact with said layer of electrical insulation, a movable electrical contact being mounted on the actuator for engagement with said stationary electrical contact.

2. A switch as claimed in claim 1 wherein one of said switch members has ear portions which are deformed over the other of said switch members to mechanically interengage said switch members.

3. A switch as claimed in claim 2 wherein said first switch member comprises said other switch member and said second switch member comprises said one switch member.

4. A switch as claimed in claim 2 including means for preventing movement of said switch members relative to each other.

5. A switch as claimed in claim 4 further comprising at least a first projecting portion on one switch member and a complementary recess on the other switch member.

6. A switch as claimed in claim 1 including an adhesive bond between each switch member and said insulation layer.

7. A switch member as claimed in claim 6 wherein said insulation layer is impregnated with adhesive.

8. A switch as claimed in claim 1 wherein said insulation layer comprises a polyamide based paper.

9. A switch as claimed in claim 1 wherein each member has an integral terminal portion.

10. A switch as claimed in claim 1 wherein said actuator is mounted to said second switch member at a single point.

11. A switch as claimed in claim 1 including a cover arranged to shroud the component parts of said switch, the cover having a flange portion carrying a projection arranged to engage in an aperture in one of said switch members for locating the cover.

12. A thermally responsive electric switch including two switch members formed from sheet metal, said switch members being disposed in face to face relationship, said switch members being electrically isolated from one another by a strip of electrically-insulating sheet material sandwiched therebetween, said strip of insulating sheet material being provided with an aperture therethrough, the second of said switch members also having an aperture therethrough, at least a first of said switch members being physically deformed whereby said switch members are secured together by mechanical interengagement with one another with said apertures being in registration with one another, a stationary electrical contact being mounted on a first one of said switch members in a position where said stationary contact extends through said aperture in said insulating sheet material, a snap-acting actuator of sheet bi-metal being mounted on the face of said second one of said switch members which is disposed opposite to the face of said second switch member which is in contact with said strip of insulating sheet material, and a movable electrical contact mounted on said actuator, said movable electrical contact engaging said stationary contact through said aperture in said second switch member.

13. A switch as claimed in claim 12 wherein one of said switch members has ear portions which are deformed over the other of said switch members to mechanically interengage said switch members.

14. A switch as claimed in claim 13 including an adhesive bond between each switch member and said insulation layer.

* * * * *